United States Patent [19]

Wako

[11] Patent Number: 4,831,223

[45] Date of Patent: May 16, 1989

[54] PUSH-BUTTON SWITCH

[75] Inventor: Soichi Wako, Sagamihara, Japan

[73] Assignee: Jelco Co. Ltd., Japan

[21] Appl. No.: 30,023

[22] Filed: Mar. 25, 1987

[51] Int. Cl.[4] ..... H01H 3/12

[52] U.S. Cl. ..... 200/517; 200/290

[58] Field of Search ..... 200/340, 5 A, 159 R, 200/159 B, 250, 276, 290

[56] References Cited

U.S. PATENT DOCUMENTS

| | | | |
|---|---|---|---|
| 3,586,810 | 6/1971 | Brown | 200/302.2 |
| 4,313,685 | 2/1982 | Stahl et al. | 200/159 R |
| 4,468,542 | 8/1984 | Pounds | 200/159 B |
| 4,529,848 | 7/1985 | Cherry | 200/340 |
| 4,613,737 | 9/1986 | Nishijima | 200/340 |
| 4,755,645 | 7/1988 | Naoki et al. | 200/340 |

*Primary Examiner*—Henry J. Recla
*Assistant Examiner*—Linda J. Sholl
*Attorney, Agent, or Firm*—Diller, Ramik & Wight

[57] ABSTRACT

In a push-button switch, serially connected first, second and third coaxial springs having gradually increasing diameters are disposed between a key top and contact members, a key stem extends through the second and third springs for operating the contact members through the first spring.

5 Claims, 3 Drawing Sheets

PUSH-BUTTON SWITCH

BACKGROUND OF THE INVENTION

This invention relates to a push-button switch.

In a push-button switch generally used on a keyboard or the like, in order to decrease the manufacturing cost, it is important to decrease as far as possible the number of component parts so as to simplify the construction, as well as the number of assembling steps.

FIG. 1 illustrates a conventional push-button comprising a key stem 2 provided with a top or cap 1 and arranged to be slidable in the vertical direction through a mounting frame 3, a restoring spring 4 inserted between the top 1 and the mounting frame 3 and a spring 5 received in a bottom opening of the stem 2 for pressing contacts 8*a* and 8*b* through a film 8, the contacts being supported by a bottom plate 6 through an insulating spacer 7.

In another conventional switch shown in FIG. 2, the top 9*a* and the stem 9*b* are formed integrally suing a plastic so as to decrease the number of the component parts. In FIG. 2, elements corresponding to those shown in FIG. 1 are designated by the same reference numerals.

SUMMARY OF THE INVENTION

Accordingly, it is an object of this invention to provide an improved push-button switch capable of decreasing the number of component parts than the prior art. push-button switches thereby decreasing the manufacturing cost.

Another object of this invention is to provide a novel push-button switch capable of giving a feeling of switch ON and preventing chattering of the contacts when they are closed and opened.

According to this invention, there is provided a push-button switch comprising a key having a top and a stem connected thereto, contact means opened and closed by the stem, a first spring disposed between one end of the stem and the contact means for pressing the contact means, and a second and third springs surrounding the stem and acting to restore the key, the second spring having a diameter larger than the first spring, and the third spring having a diameter larger than the second spring and being formed integral with the first and second springs.

DESCRIPTION OF THE PREFERRED EMBODIMENTS

Figure 1:
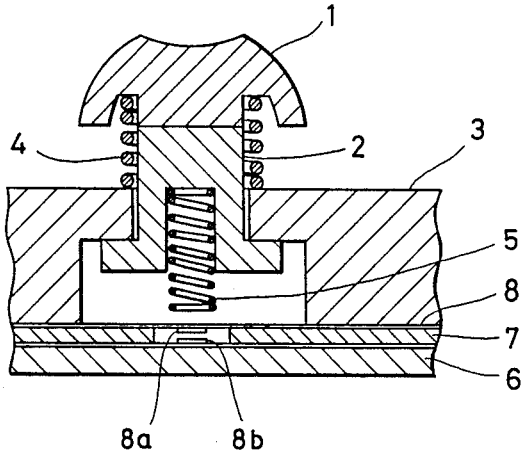
FIG. 1 PRIOR ART
FIGS. 1 and 2 are vertical sectional views showing typical prior art push-button switches.
Figure 2:
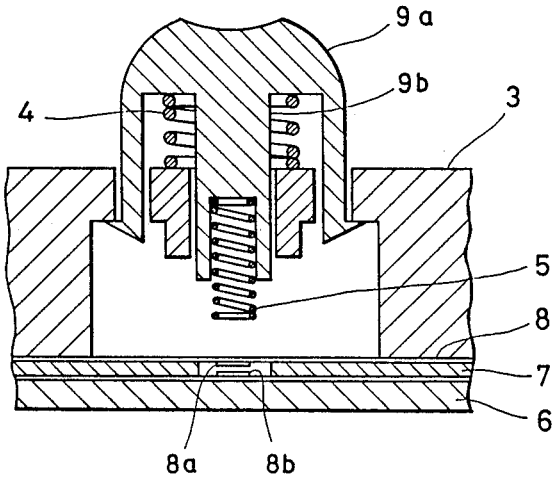
FIG. 2 PRIOR ART
Figure 3:
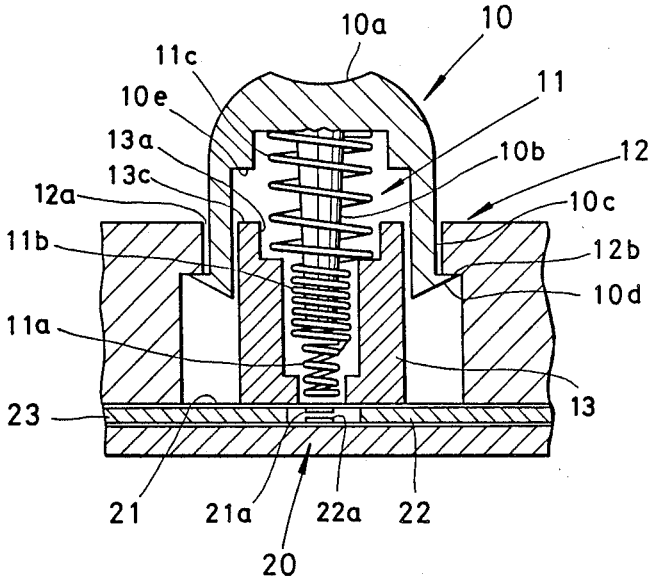
FIG. 3 is a vertical sectional view showing one embodiment of the push-button switch according to the invention.

The first embodiment of the push-button switch shown in FIG. 3 comprises a key 10, a spring assembly 11, a mounting frame 12 and a film contact member 20 mounted on a bottom plate 13.

The key 10 is made of a plastic and its top 10*a*, stem 10*b* and sliding member 10*c* are formed integrally. The key 10 is mounted on a mounting frame 12 with the sliding member inserted into an opening 12*a* of the frame 12 so as to move in the vertical direction between a position at which an engaging member 10*d* at the lower end of the sliding member 10*c* engages the lower surface 12*b* of frame 12 and a position at which an engaging member 10*e* at the base portion of the sliding member 10*c* engages the upper surface 13*c* of a hollow cylindrical member 13 of the frame 12. The cylindrical member 13 is formed with a recess 13*a* at its upper end.

The spring assembly 11 is constituted by serially connected three coaxial springs 11*a*, 11*b* and 11*c* having different diameters of which spring 11*a* is used to press the film contact member 20, while springs 11*b* and 11*c* are formed integrally to return the key 10 to the original position. The lower end of spring 11*b* is connected to the lower end of stem 10*b*.

The film contact member 20 is constituted by a film 21 carrying a upper contact 21*a*, a film 22 carrying a lower contact 22*a* and a spacer 23 interposed between films 21 and 22 for defining a predetermined gap between the contacts 21*a* and 22*a*.

The push-button switch sown in FIG. 3 operates as follows.

In a state shown in FIG. 3 in which the key 10 is not depressed, the key is urged upwardly by the force of spring 11*c* whereby the switch is open.

As the key 10 is depressed gradually, spring 11*c* is firstly compressed and then the spring 11*c* is further compressed after the lower end of the stem 11*b* engages the upper surface of the spring 11*a*. Then densely wound spring 11*b* is extended to lower the spring 11*a*. As a consequence, the film 21 is pressed and deformed to urge upper contact 21*a* against lower contact 22*a* to close these contacts. After closing the contacts, when the key is depressed further, spring 11*a* will be compressed by an amount corresponding to the extent of depression.

The pressing force caused by the depression of the key varies stepwisely at the times of compression of only spring 11*c*, and compression of spring 11*c* and extension of spring 11*b*. Such stepwise variations of the pressing force gives a feeling of switch ON to a finger of the operator. Furthermore, as the stroke of the key can be continued after the contacts have been closed, it is possible to prevent chattering at the time of opening and closing the switch.

Figure 4:
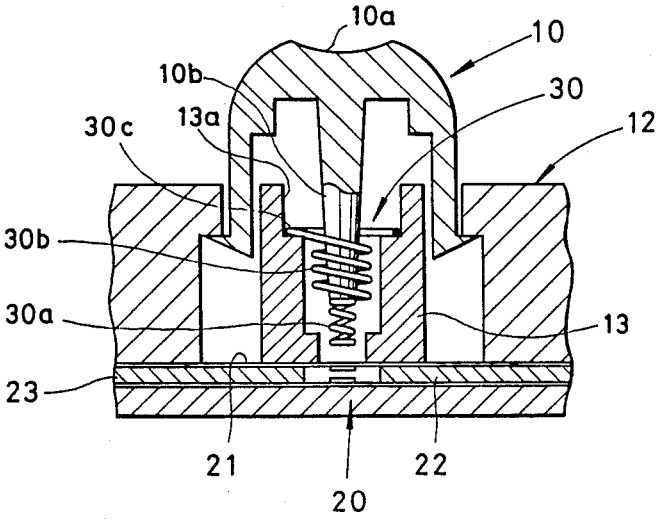
FIGS. 4 and 5 are vertical sectional views showing another embodiments of this invention.
Figure 5:
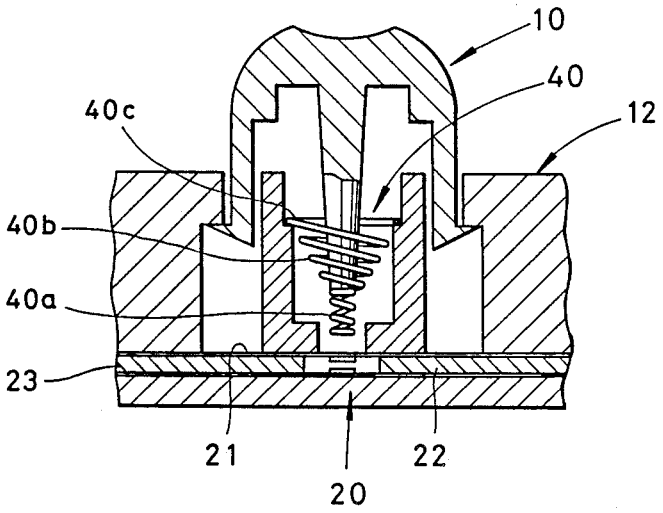

FIG. 4 shows another embodiment of this invention in which elements corresponding to those shown in FIG. 3 are designated by the same reference numerals.

This modified embodiment is different form the embodiment shown in FIG. 3 in the construction of spring 30. Thus, the spring assembly 30 is constituted by serially connected springs 30*a*, 30*b* and 30*c* having different diameters of which spring 30*a* is used to depress contact member 20, spring 30*b* is used to restore the key 10 to the original position and spring 30*c* is used to secure the spring assembly 30 to be mounting frame 12.

The upper end of spring 30*a* normally engages with the lower end of the stem 10*b*, spring 30*c* is normally arrested by the bottom surface of the recess 13*a* of the hollow cylindrical member 13 of the mounting frame 12, and spring 30*b* normally applies upward restoring force to the key 10.

As the key 10 is depressed down against the restoring force of spring 30*b*, key 10 moves down while extending spring 30*b* so that spring 30*a* at the lower side of stem 10*b* presses the contact member 20 to close the switch.

Although in this embodiment, the top, stem and sliding portion of the key are formed as an integral unit, these portions may be formed independently and then bonded together to form a key. Furthermore, the contact member is not limited to film contacts and ordinary contacts that can be opened and closed by the vertical movement of the spring can be used. the embodiment in FIG. 4 except that the spring 40*b* is of conical shape. Since the function and operation are same as the embodiment of FIG. 4, explanation will be omitted.

As above described, according to this invention, a contact pressing spring and a key restoring spring which have been formed independingly are formed integrally so that it is possible to decrease the number of component parts and the manufacturing cost.

What is claimed is:

1. A push-button switch comprising:

a switch mounting frame including spaced first and second faces and a hole communicating therebetween;

contact means provided on said first face for movement between open and closed switch positions;

a key including a key top, a rear surface and a key stem projecting form said rear surface; said key stem having one end connected to said key top and another end thereof projection toward said contact means; said key being movable between first and second positions at which said key another end is respectively close to and more remote from said contact means;

spring means including a coil spring for operating said contact means for movement thereof between said open and closed switch positions; said coil spring having first, second and third coil spring portions; said second coil spring portion being between said first and third coil spring portions; said first coil spring portion being immediately adjacent said contact means as compared to the more remote positions of said second and third coil spring portions from said contact means; said coil spring being at least in partial exterior surrounding relationship to said key stem; a first end of said first coil spring portion being connected to a first end of said second coil spring portion; said second coil spring portion having a coil diameter respectively larger and smaller than that of said first and third coil spring portions; said first coil spring portion first end being normally axially spaced from but aligned for abutment with said key stem another end when said key is in said second position thereof;

means for compressing said third coil spring portion during initial movement of said key stem another end toward said contact means from said second position to said first position thereof thereby establishing a restoration force in said first coil spring portion;

continued movement of said key stem another end toward said first position thereof causing abutment of said key stem another end with said first coil spring portion first end after which further movement of said key stem anther end causes expansion of said second coil spring portion;

final continued movement of said key stem another end compresses said first coil spring portion and moves said contact means to said closed switch position; and restoration of said key stem is effected upon release of said key stem whereupon said first and third coil spring portions expand and said second coil spring portion contracts to release the spring biasing forces thereof and return said key stem another end to the second position thereof.

2. The push-button switch as defined in claim 1 wherein said hole is defined by a generally cylindrical wall, said cylindrical wall opens into a recess, said recess includes a peripheral edge, and said third coil spring compressing means is defined by said peripheral edge being disposed in opposing relationship to said rear surface and confining therebetween said third coil spring portion.

3. The push-button switch as defined in claim 1 wherein said key top carries a depending skirt in external surrounding relationship to said key stem, and said switch mounting frame includes a peripheral wall in external guiding relationship to said depending skirt whereby said key is guided during movement of said key between the first and second positions thereof.

4. The push-button switch as defined in claim 3 including cooperative means between said key skirt and said peripheral wall for precluding inadvertent axial disassembly therebetween.

5. The push-button switch as defined in claim 4 wherein said cooperative disassembly precluding means are axially aligned abutments carried by said key skirt and said peripheral wall.

* * * * *